US005771699A

United States Patent [19]

Ponder

[11] Patent Number: 5,771,699

[45] Date of Patent: Jun. 30, 1998

[54] THREE COIL ELECTRIC HEAT PUMP

[76] Inventor: Henderson F. Ponder, P.O. Box 145, Summerville, Ga. 30747

[21] Appl. No.: 720,581

[22] Filed: Oct. 2, 1996

[51] Int. Cl.[6] ..... F25B 41/00; F25B 47/00

[52] U.S. Cl. ..... 62/81; 62/151; 62/160; 62/278

[58] Field of Search ..... 62/156, 278, 81, 62/324.5, 277, 160, 152, 151, 155, 186

[56] References Cited

U.S. PATENT DOCUMENTS

| | | | |
|---|---|---|---|
| 1,821,754 | 9/1931 | Huyette . | |
| 2,110,693 | 3/1938 | Bailey . | |
| 2,195,924 | 4/1940 | Hoesel . | |
| 2,297,970 | 10/1942 | Merz . | |
| 2,401,560 | 6/1946 | Graham et al. . | |
| 2,474,304 | 6/1949 | Clancy . | |
| 2,780,442 | 2/1957 | Breeding . | |
| 2,793,834 | 5/1957 | Henney et al. . | |
| 2,806,674 | 9/1957 | Biehn | 257/3 |
| 2,919,558 | 1/1960 | Lauer . | |
| 2,970,816 | 2/1961 | McCarty . | |
| 3,006,613 | 10/1961 | Coyne | 257/290 |
| 3,103,794 | 9/1963 | Kyle et al. | 62/160 |
| 3,176,760 | 4/1965 | Murdoch | 165/29 |
| 3,189,085 | 6/1965 | Eberhart | 165/12 |
| 3,219,102 | 11/1965 | Taylor . | |
| 3,318,372 | 5/1967 | Shell . | |
| 3,444,923 | 5/1969 | Kyle et al. | 165/29 |
| 3,529,659 | 9/1970 | Trask | 165/29 |
| 3,732,703 | 5/1973 | Nordstrom et al. | 62/324.3 |
| 3,867,979 | 2/1975 | Carrasse et al. | 165/29 |
| 4,102,389 | 7/1978 | Wills | 165/29 |
| 4,102,391 | 7/1978 | Noland et al. | 165/29 |
| 4,105,064 | 8/1978 | Del Toro et al. | 165/29 |
| 4,112,705 | 9/1978 | Sisk et al. | 62/238 |
| 4,143,707 | 3/1979 | Lewis et al. | 165/28 |
| 4,178,767 | 12/1979 | Shaw | 62/324.5 X |
| 4,332,137 | 6/1982 | Hayes, Jr. | 62/81 |
| 4,373,350 | 2/1983 | Noland | 62/156 |
| 4,565,070 | 1/1986 | Raymond | 62/278 X |
| 5,095,711 | 3/1992 | Marris et al. | 62/278 X |

*Primary Examiner*—Harry B. Tanner

[57] ABSTRACT

An air conditioning system usually referred to as an electric heat pump, which employs reverse cycle refrigeration apparatus to condition air inside a building for heating in the winter months, and for cooling in the summer months, utilizing one heat exchanger coil disposed in heat exchange relation to the flow of conditioned air circulating within a building, and two heat exchanger coils disposed in heat exchange relation to the flow of ambient air circulating outside a building, wherein each said heat exchanger coil comprises a separate and singular component part of a single air conditioning circuit connected to, and served by one single compressor; and wherein, each of the said outside heat exchanger coils are designed to change functions independent of the other, from that of an evaporator, to that of a condenser, for the purpose of inhibiting the accumulation of frost on, and/or removing frost from said outside heat exchanger coil when the heat pump is operating in the heating mode without reversing the flow of refrigerant within, or impeding the flow of refrigerant to said inside heat exchanger coil, whereby said inside heat exchanger coil will continue to function in the condenser mode, and will continue to furnish heat to the inside of a building during the defrost cycle of either of the said outside heat exchanger coils, and whereby heat generated by one said outside heat exchanger coil during the defrost cycle of that coil will be reabsorbed into the heat pump system via the other outside heat exchanger coil and circulated through the same refrigeration circuit, in a manner that will improve the efficiency of said heat pump.

4 Claims, 1 Drawing Sheet

THREE COIL ELECTRIC HEAT PUMP

BACKGROUND OF THE INVENTION

This invention relates in general to air conditioning systems usually referred to as electric heat pumps, which utilize reverse cycle refrigeration apparatus to condition air inside a building for heating in the winter months, and for cooling in the summer months, and relates in particular to electric heat pump systems utilizing one heat exchanger coil disposed in heat exchange relation to the flow of conditioned air circulating within a building, (referred to hereinafter as the inside coil, or coil 3) and two heat exchanger coils disposed in heat exchange relation to the flow of ambient air circulating outside a building, (referred to hereinafter as the outside coils, or coils 1 and 2) wherein, each said heat exchanger coil 1, 2 and 3 comprises a separate and singular component part of a single air conditioning circuit which is connected to, and served by, one single compressor; and wherein, each of the said outside heat exchanger coils are designed to change functions independent of the other, from that of an evaporator, to that of a condenser, for the purpose of inhibiting the accumulation of frost on, and/or removing frost from said outside heat exchanger coils when the heat pump is operating in the heating mode without reversing the flow of refrigerant within, and/or without impeding the flow of refrigerant to said inside heat exchanger coil.

The use of heat from within a heat pump system itself to defrost the outside coil of a conventional electric heat pump is old and well known. However, the typical method is to reverse the flow of refrigerant inside the system so that the inside coil of the heat pump which is used as a condenser when the heat pump is operating in the heating mode, is converted to an evaporator, causing that coil to become cold, and the outside coil which is used as an evaporator when the heat pump is operating in the heating mode, is converted to a condenser, causing that coil to become hot. In reality, the heat pump is converted to an air conditioner for the duration of the defrost cycle.

Consequently, heat pumps of the prior art operate to collect heat from inside a building and to use such heat to defrost the outside coil of the heat pump, which is changed to a condenser for the duration of the defrost cycle, allowing such heat to radiate into the ambient air outside the building and to be lost. The system is thus required to operate for a considerable amount of time after returning to the heating mode, just to recover the heat lost during the defrost cycle, and as a result, the efficiency of the heat pump is diminished considerably.

In general terms, when a conventional electric heat pump is operating in the heating mode, a liquid refrigerant is pumped through a system of pipes, valves and coils. When it passes through the outside coil, a heat exchanger coil which is disposed outside the area to be heated, the refrigerant becomes very cold as it changes from liquid to vapor. Heat is absorbed into the system as ambient air is caused to pass over and through the external surfaces of the outside coil of the heat pump by a fan. The refrigerant is then passed through a compressor, which increases both its pressure and temperature. From there, the heated vapor goes to the inside coil, a heat exchanger coil which is disposed inside a warm air duct, where the heat is absorbed and carried inside the area to be heated. When it passes through the inside coil the refrigerant is condensed, changing back to a liquid. It then flows through a valve and back to the outside coil to continue the cycle.

When a conventional heat pump is to operate in the air conditioning mode, a reversing valve changes the direction in which the refrigerant moves through the system. This causes the inside coil to act as an evaporator and the outside coil to act as a condenser. Heat is thus absorbed from the air inside the building and discharged outside.

When the conventional heat pump requires defrosting, the flow of refrigerant is reversed and the heat pump is converted to an air conditioner for the duration of the defrost cycle. While the system is operating in the defrost mode, heat is absorbed from inside the building and discharged into the ambient air outside. Consequently, the building requiring heat, looses heat instead.

Furthermore, many heat pumps of the prior art have disposed therein, usually near the inside coil, a number of electric heat elements which are used to supply additional heat when needed or desired. Switching devises are used to turn these heat elements on during the defrost cycle in an effort to restore to the building some of the heat lost when the flow of refrigerant is reversed. However, much of the heat generated by these heat elements radiates directly to the inside coil which is then the coldest object in the vicinity. This is due to the fact that heat always moves from a warm body to a cold body. Since heat radiates at a speed which is many thousand times faster than the speed of the air passing through the air duct, it should be obvious that much of the heat generated by the heat elements, especially heat that is radiated from the back side of the heat elements, will go to the inside coil of the heat pump, which is then operating as an evaporator, and be absorbed into the heat pump system and carried to the outside coil where it is wasted to the ambient air.

SUMMARY OF INVENTION

Accordingly, the object of the present invention is to provide an electric heat pump system, utilizing one heat exchanger coil disposed in heat exchange relation to the flow of conditioned air circulating within a building, and two heat exchanger coils disposed in heat exchange relation to the flow of ambient air circulating outside a building, wherein each said heat exchanger coil comprises a separate and singular component part of a single air conditioning circuit connected to, and served by one single compressor; and wherein, each of the said outside heat exchanger coils are designed to change functions independent of the other, from that of an evaporator to that of a condenser, for the purpose of inhibiting the accumulation of frost on, and/or removing frost from said outside heat exchanger coil when the heat pump is operating in the heating mode without reversing the flow of refrigerant within, and/or without impeding the flow of refrigerant to said inside heat exchanger coil, and in a manner that will allow said inside heat exchanger coil to continue to operate in the condenser mode during the defrost cycle.

Test show that when an electric heat pump is operating in the heating mode, more heat is collected from a given volume of air when the temperature of the air is high than is collected from the same volume of air at a lower temperature. Further test show that the temperature of the air exiting the inside coil of an electric heat a pump is higher when the temperature of the air interring the coil is raised by heat from an external source. This proves that additional heat applied to the external surfaces of the outside coil of an electric heat pump is absorbed and carried through the heat pump system to the inside coil where it is discharged into the building.

Consequently, it is another object of the present invention to provide an electric heat pump system whereby heat generated by one outside heat exchanger coil during the defrost cycle of that coil will be absorbed into another outside heat exchanger coil within the same refrigeration circuit, in a manner that will improve the efficiency of said heat pump.

The nature and objects of the present invention will become more readily apparent from the following description of a preferred embodiment as described below and shown in the attached drawings.

DESCRIPTION OF THE PRESENT INVENTION

Figure 1:
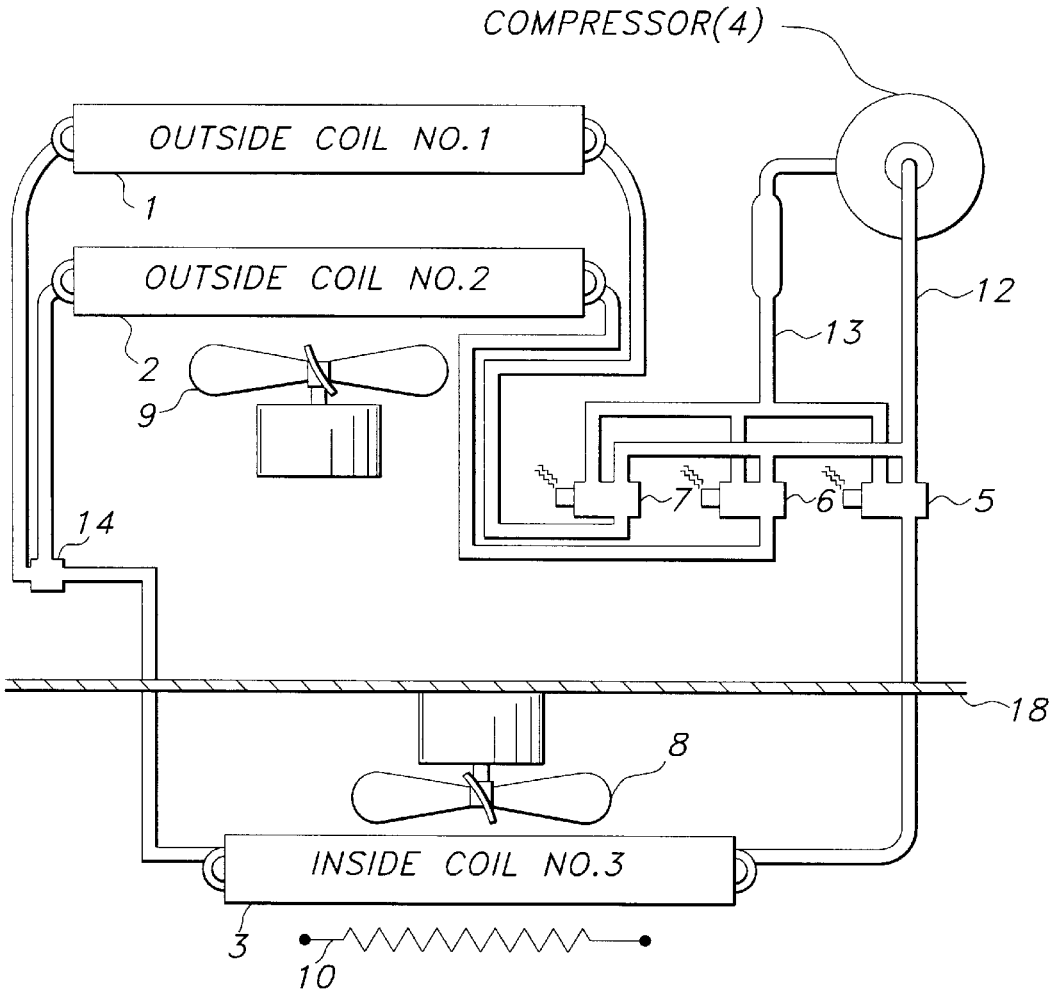
FIG. 1 shows a pictorial view of an electric heat pump with added apparatus denoting elements of the present invention.

The present invention proposes to add a second heat exchanger coil in heat exchange relation with the flow of ambient air in the outside compartment of an electric heat pump. This coil is disposed to function in the same mode as the regular outside coil of the heat pump, both when the heat pump is operating in the heating mode and when the heat pump is operating in the air conditioning mode. However, when the heat pump is operating in the heating mode and defrosting of one of the outside coils is required, the coil requiring defrosting will change functions from that of an evaporator to that of a condenser for a period of time, while the other coil continues to function as an evaporator without reversing the flow of refrigerant within, and/or without impeding the flow of refrigerant to said inside heat exchanger coil. When the first outside heat exchanger coil has finished defrosting, it will return to the evaporator mode, giving the other outside coil of the heat pump an opportunity to defrost in the same manner. When both outside coils are free of frost, they will function together as evaporators and continue to collect heat from the ambient air outside the building until further defrosting is required, or until the heat pump is changed to the air conditioning mode, or turned off.

In other words, when the heat pump is operating in the air conditioning mode, the inside coil is disposed to function as an evaporator, and both of the outside coils are disposed to function as condensers. When the heat pump is operating in the heating mode, the inside coil is disposed to function as a condenser, and both of the outside coils are disposed to function as evaporators. When the heat pump is operating in the heating mode and one of the outside coils requires defrosting, the inside coil continues to function as a condenser, while one of the outside coils continues to function as an evaporator, and the outside coil requiring defrosting is changed to function as a condenser. When the defrost cycle is over, the outside coil being defrosted will change its function back to that of an evaporator, and the other outside coil, if defrosting is required, will be disposed to function in the condenser mode.

When the outside coil which is positioned in the upstream ambient air flow is in the defrost mode, appropriate switching devices may be employed to cause the fan supplying the outside coils with ambient air to operate at a slow speed so that heat generated by the coil in the upstream ambient air flow will be more readily absorbed into the coil positioned in the downstream ambient air flow. Conversely, when the outside coil which is positioned in the downstream ambient air flow is in the defrost mode, the fan supplying the outside coils with ambient air could be set at a slow speed, and reversed so that ambient air will flow in the opposite direction. This will allow the coil positioned in the upstream flow of ambient air to more readily absorb heat generated by the coil positioned in the downstream flow in the same manner as stated above.

To understand the components of the present invention and how they work, turn to FIG. 1 where there is shown generally the embodiment of an electric heat pump utilizing the three coil system proposed herein. At 1, there is shown an outside heat exchanger coil referred to hereinafter as coil 1, at 2 another outside heat exchanger coil referred to hereinafter as coil 2, at 3 an inside heat exchanger coil referred to hereinafter as coil 3, at 4 a compressor, at 5 a two way solenoid operated reversing valve, at 6 another two way solenoid operated reversing valve, at 7 yet another two way solenoid operated reversing valve, at 8 a fan, at 9 another fan, at 10 an electric heat element, at 12 a pipe, at 13 another pipe, at 14 a pipe junction, and at 18 a partition.

Coil 1 is placed in the upstream flow of ambient air entering the outside chamber of the heat pump, and coil 2 is placed in the downstream flow in a position immediately behind coil 1 in a manner that will allow ambient air to flow over and through the external surfaces of coil 1 before flowing over and through the external surfaces of coil 2 when the heat pump is operating in either the heating or the air conditioning mode.

Coil 3 is placed in the inside chamber of the heat pump in a manner that will allow conditioned air circulating within the building served by the heat pump to flow over and through the external surfaces of that coil before re-entering the building.

The compressor 4 is disposed to deliver hot refrigerant through the hot gas output line 12, to each of the coils at 1, 2, and 3 independently, via the two way solenoid operated reversing valves 5, 6, and 7, and to receive vaporized refrigerant through suction line 13 from each of the coils independently via the two way solenoid operated reversing valves depending on whether such coil is functioning as a condenser, or as an evaporator.

The two way solenoid operated reversing valves at 5, 6, and 7 are disposed to receive hot refrigerant from the compressor via the hot gas output line 12, and to deliver same to each of the coils at 1, 2, and 3 independently, or to receive vaporized refrigerant from each of the coils independently, and deliver same to the compressor via suction line 13, depending on whether such coil is functioning as a condenser, or as an evaporator.

The fan at 8 is disposed to circulate conditioned air within a building by receiving air from inside the building through a return air duct, and causing said air to pass over and through the external surfaces of the inside coil at 3 before returning it to the building through another duct.

The fan at 9 is disposed to circulate ambient air over and through the external surfaces of the outside coils 1, and 2. This fan is designed to draw ambient air into the enclosure causing air to pass first over and through the external surfaces of coil 1, and then over and through the external surfaces of coil 2, and is caused to function at full speed both in the air conditioning mode, and in the heating mode. However, if desired, when coil 1 is functioning in the defrost mode, appropriate switching devices may be employed to cause the motor of fan 9 to be set at a slow speed, and when coil 2 is functioning in the defrost mode, the motor of fan 9 could be set at a slow speed, and reversed, so that air will flow in the opposite direction.

The electric heat element at 10 is disposed to provide auxiliary heat to the building when needed or desired. The operation of this heat element is provided in the same manner as in conventional electric heat pumps of the prior art, and is not detailed herein.

Pipe 12 is disposed to deliver hot refrigerant vapor from the compressor 4, to each of the heat exchanger coils 1, 2, and 3, independently, via two way solenoid operated reversing valves 5, 6, and 7, when such heat exchanger coil is to function as a condenser.

Pipe 13 is disposed to extract vaporized refrigerant from each of the heat exchanger coils 1, 2, and 3, independently, via the two way solenoid operated reversing valves 5, 6, and 7, and to deliver same to the compressor 4, when such heat exchanger coil is to function as an evaporator.

The pipe junction at 14 is disposed to receive condensed refrigerant from each of the coils 1, 2, and 3 independently, and to deliver same to each of the coils independently, depending on whether such coil is functioning as a condenser or as an evaporator.

Partition 18 is disposed to separate the outside compartment of the heat pump, and its components, from the inside compartment, and its components.

Each of the two way solenoid operated reversing valves shown in FIG. 1 at 5, 6 and 7 is designed to cause hot refrigerant vapor from the compressor to flow to the heat exchanger coil served by such reversing valve when the solenoid of such reversing valve is energized. Conversely, each of the said two way solenoid operated reversing valves is designed to cause vaporized refrigerant to be extracted from the heat exchanger coil served by such reversing valve when the solenoid of such reversing valve is deenergized.

It will be obvious that a thermostat switching device such as that employed in heat pumps of the prior art should be used to energize and de-energize the two way solenoid operated reversing valves shown in FIG. 1 at 5, 6 and 7.

When the heat pump is to operate in the air conditioning mode, reversing valves 6 and 7 will be energized so that hot refrigerant will be delivered to outside coils 1 and 2 via pipe 12, and reversing valve 5 will be de-energized so that vaporized refrigerant will be extracted from coil 3 via pipe 13. Conversely, when the heat pump is to operate in the heating mode, reversing valve 5 will be energized so that hot refrigerant will be delivered to inside coil 3, and reversing valves 6 and 7 will be de-energized so that vaporized refrigerant will be extracted form outside coils 1 and 2.

When either of the outside coils 1 or 2 requires defrosting, appropriate switching devices may be employed to energize reversing valves 6 or 7 independently, and cause the coil served by such reversing valve to function in the condenser mode for a given period of time so that the coil will be defrosted.

It should be noted that a source of power other than the circuit employed by means of the thermostat to energize the two way solenoid operated reversing valves for normal operation should be used to energize reversing valves 6 and 7 when either of the outside coils 1 or 2 require defrosting. Also, it is important to insure that all three of the heat exchanger coils are not allowed to operate in the same mode at the same time.

Some heat pumps of the prior art use simple timing devices to determine when the outside coil of the heat pump requires defrosting. These timers act to defrost the evaporator coil of the heat pump at timed intervals. Other systems employ a variety of pressure and temperature sensing devices designed to determine when the outside coil of the heat pump requires defrosting. It will be obvious that each of the outside coils I and 2 of the present invention should be equipped with such timing device, or other sensing device, so that the switching devices used to energized the two way solenoid operated reversing valves 6 and 7 can be employed independently when one of the outside coils require defrosting.

Furthermore, it will be obvious that when either of the two outside heat exchanger coils is undergoing defrosting, the other outside coil will continue to function as an evaporator and collect heat from both the ambient air, and the coil undergoing defrosting. After processing through the compressor, part of such heat will go to the inside coil, and part will go to the outside coil which is undergoing defrosting where it will be recycled back into the same refrigeration circuit via the other outside coil which is still functioning as an evaporator. Although this will tend to slightly raise the threshold from which heat is collected from ambient air, the recycled heat should more than offset the balance and cause the temperature of the air exiting the inside coil of the heat pump to remain approximately the same, if not higher. In any event, virtually all of the heat used to defrost the outside coil of the heat pump will be contained. Little, if any of the heat will be wasted to the ambient air outside the building, and additional operating time will not be required to replace heat lost during the defrost cycle as would otherwise be the case with prior art systems.

Although the disclosed embodiment of the present invention finds utility in an electric heat pump utilizing one heat exchanger coil disposed in heat exchange relation with conditioned air circulating within a building, and two heat exchanger coils disposed in heat exchange relation with ambient air circulating outside a building, wherein each said outside heat exchanger coil is designed to change functions from that of an evaporator to that of a condenser independent of the other said heat exchanger coils in order to inhibit the accumulation of frost thereon, or to defrost said outside heat exchanger coil, it should be understood that the foregoing relates only to a disclosed embodiment, and numerous changes and modifications may be made therein without departing from the spirit and scope of the present invention as defined in the following claims.

Wherefore, the following is claimed:

1. A three coil electric heat pump, comprising:

(a) a compressor, (b) a first outside heat exchanger coil connected by a fluidic piping to said compressor, (c) a second outside heat exchanger coil connected to said first outside heat exchanger coil and said compressor by said fluidic piping, (d) an inside heat exchanger coil connected to said first outside heat exchanger coil, said second outside heat exchanger coil and said compressor by said fluidic piping, wherein heat will radiate from said first outside heat exchanger coil and be reabsorbed into the same refrigeration circuit within the heat pump system via said second outside heat exchanger coil when said inside heat exchanger coil functions as a condenser, and said first outside heat exchanger coil functions as a condenser, and said second outside heat exchanger coil functions as an evaporator for defrosting said first outside heat exchanger coil.

2. The three coil electric heat pump of claim 1, wherein heat will radiate from said second outside heat exchanger coil and be reabsorbed into the same refrigeration circuit within the heat pump system via said first outside heat exchanger coil when said inside heat exchanger coil functions as a condenser, and said second outside heat exchanger coil functions as a condenser, and said first outside heat exchanger coil functions as an evaporator for defrosting said second outside heat exchanger coil.

3. A method for defrosting the outside heat exchanger coils of a three coil electric heat pump, comprising the steps of:

(1) providing a compressor, (2) providing an inside heat exchanger coil, (3) providing a first outside heat exchanger coil, and a second outside heat exchanger coil disposed in heat exchange relation one to the other, wherein said first outside heat exchanger coil and said second outside heat exchanger coil are connected by a fluidic piping to each other and to said inside heat exchanger coil, and to said compressor, (4) operating said inside heat exchanger coil as a condenser, and said second outside heat exchanger coil as an evaporator while switching said first outside heat exchanger coil from operating as an evaporator to operating as a condenser for a period of time sufficient to defrost said first outside heat exchanger coil, in a manner that will cause heat discharged by said first outside heat exchanger coil to be reabsorbed into the same refrigeration circuit within the heat pump system via said second outside heat exchanger coil therefore improving the quality of heat discharged by said inside heat exchanger coil, and (5) operating said inside heat exchanger coil as a condenser, and said first outside heat exchanger coil as an evaporator while switching said second outside heat exchanger coil from performing as an evaporator to operating as a condenser for a period of time sufficient to defrost said second outside heat exchanger coils, in a manner that will cause heat discharged by said second outside heat exchanger coil to be reabsorbed into the same refrigeration circuit within the heat pump system via said first outside heat exchanger coil therefore improving the quality of heat discharged by said inside heat exchanger coil.

4. A method for defrosting the outside heat exchanger coils of a three coil electric heat pump, comprising the steps of:

(1) providing a compressor, (2) providing an inside heat exchanger coil, (3) providing a first outside heat exchanger coil, and a second outside heat exchanger coil disposed in heat exchange relation one to the other, wherein said first outside heat exchanger coil and said second outside heat exchanger coil are connected by a fluidic piping to each other and to said inside heat exchanger coil, and to said compressor, wherein, said inside heat exchanger coil will continue to operate in the heating mode during the defrost cycle of either of the said outside heat exchanger coils, utilizing heat collected from ambient air and heat discharged by the outside heat exchanger coil undergoing defrosting and reabsorbed into the same refrigeration circuit within the heat pump system via the other outside beat exchanger coil in a manner that will improve the quality of heat discharged by said inside heat exchanger coil.

* * * * *